US010863839B1

(12) United States Patent
Conrad, Jr.

(10) Patent No.: US 10,863,839 B1
(45) Date of Patent: Dec. 15, 2020

(54) PROTECTIVE COVER FOR POP-UP STRAW

(71) Applicant: Edward Conrad, Jr., E. St. Louis, IL (US)

(72) Inventor: Edward Conrad, Jr., E. St. Louis, IL (US)

( * ) Notice: Subject to any disclaimer, the term of this patent is extended or adjusted under 35 U.S.C. 154(b) by 238 days.

(21) Appl. No.: 16/041,750

(22) Filed: Jul. 21, 2018

(51) Int. Cl.
*A47G 19/00* (2006.01)
*A47G 19/22* (2006.01)

(52) U.S. Cl.
CPC ..... *A47G 19/2222* (2013.01)

(58) Field of Classification Search
CPC ..... A47G 19/2272; A47G 19/2266; A47G 21/186; A47G 21/189; A47G 21/182; A47G 21/18
USPC ..... 220/709, 708; 215/229
See application file for complete search history.

(56) References Cited

U.S. PATENT DOCUMENTS

| | | | | |
|---|---|---|---|---|
| 113,016 | A | 3/1871 | Bun-Ob | |
| 233,303 | A | 10/1880 | Walkee | |
| 497,999 | A | 5/1893 | Windus | |
| 863,398 | A | 8/1907 | Ivanoff | |
| 1,497,199 | A | 6/1924 | Sutthoff | |
| 2,939,603 | A | 6/1960 | Young | |
| 2,969,064 | A | 1/1961 | Metz | |
| 3,356,245 | A | 12/1967 | Little | |
| 3,610,566 | A | 10/1971 | Rychlik | |
| 3,741,447 | A | 6/1973 | Mc Ghie et al. | |
| 3,779,507 | A | 12/1973 | Clarke | |
| 4,114,640 | A | 9/1978 | Forman | |
| 4,634,421 | A | 1/1987 | Hegemann | |
| 4,643,389 | A | 2/1987 | Elson et al. | |
| 5,203,468 | A | 4/1993 | Hsu | |
| 5,238,160 | A | 8/1993 | Faulds | |
| 5,273,172 | A | 12/1993 | Rossbach et al. | |
| 5,282,541 | A | 2/1994 | Chen | |
| 5,320,256 | A | 6/1994 | Wood | |
| 5,427,274 | A | 6/1995 | Wood | |
| 5,897,013 | A * | 4/1999 | Manganiello | A47G 19/2266 215/229 |
| 6,196,413 | B1 | 3/2001 | Tung | |
| 7,140,509 | B2 | 11/2006 | Yang | |
| 7,210,602 | B2 | 5/2007 | Blanchester | |
| 2005/0029271 | A1 | 2/2005 | McDonough | |
| 2005/0133519 | A1 | 6/2005 | McDonough | |
| 2008/0099494 | A1* | 5/2008 | Boukais | B65D 47/063 220/709 |

* cited by examiner

*Primary Examiner* — King M Chu
(74) *Attorney, Agent, or Firm* — Grace J. Fishel

(57) ABSTRACT

A protective enclosure for straws used to consume beverages is disclosed. The protective enclosure may be operated by one hand to selectively access or cover an end of a straw through which a beverage may be consumed. The protective enclosure has a clamshell like opening and closing operation, portions of which are interdigitated and pivot during operation. The protective enclosure has a mechanism which selectively extends and retracts the straw during operation of the device. The protective enclosure may have an additional seal or seals to exclude contamination from dirt and/or insects during use.

18 Claims, 3 Drawing Sheets

PROTECTIVE COVER FOR POP-UP STRAW

BACKGROUND OF THE INVENTION

1. Field of the Invention

The present invention relates to a protective cover that protects the drinking tip and pops-up a straw.

2. Brief Description of the Prior Art

It is known to provide packaging for beverages in a form which is adapted to be used with a straw. Typical drinks in this form include milk, juices, soda, water, iced tea and so forth. There is a need for a device which covers the drinking tip of a straw such that it is kept clean between sips. Placing a cap on the straw is an obvious solution but caps are difficult to manipulate and easily lost unless attached to the straw with a band.

U.S. Pat. Nos. D.327,848, D.408,220, 136,309, 729,423, 945,879, 1,876,988, 2,002,835, 2,112,625, 2,613,988, 2,796,228, 3,438,607, 4,407,434, 4,448,316, 5,048,709, 5,201,460, 5,388,712, 5,465,866, 5,484,080, 5,884,793, 5,908,126, 6,113,062, 6,116,458, 6,202,716, 6,227,403, 6,276,560, 6,371,329, 6,499,614, and 6,585,170 together with U.S. patent application Nos. 2002/0040909 and 2003/0102318 are incorporated by reference herein.

BRIEF SUMMARY OF THE INVENTION

The protective cover of the invention provides a mechanism for protecting the drinking tip of a straw from contamination by dirt, insects and so forth. The device can be operated with one hand by simply squeezing a clamshell-like housing when a user desires a sip of his or her beverage. The top of the device opens and the straw is pushed upwardly where it can be used in the usual manner. When pressure on the device is released, the straw drops back under the protective cover. The device is especially useful in an outdoor setting, where contamination from windblown dirt and from insects is more likely. However, the device may be used anywhere to protect the drinking tip of a straw from contamination. The device is eye-catching, entertaining, practical, effective and inexpensive to manufacture.

It is thus an object of this invention to provide a device to protect a drinking tip of a straw from contamination. It is another object to provide a device which causes the straw to pop-up as the tip is uncovered. Another object is to provide a device that can be operated with one hand. Other objects and features of the invention will be in part apparent and in part pointed out hereinafter.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
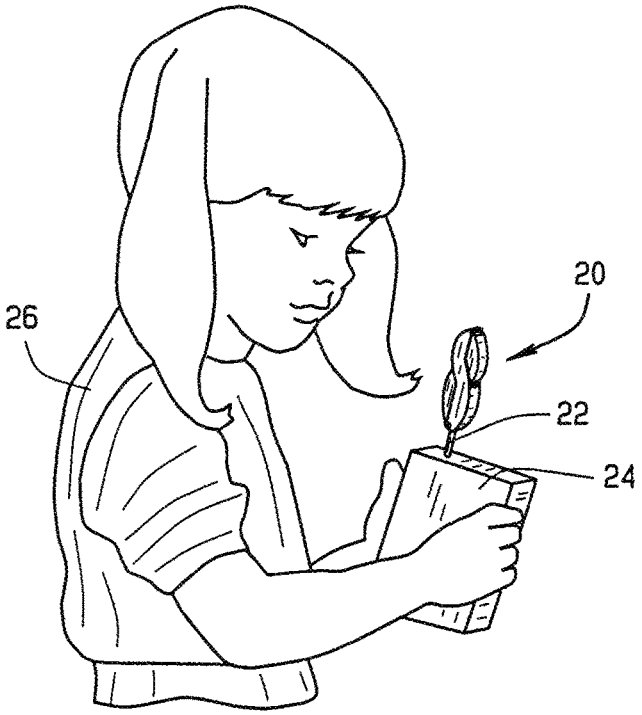
FIG. 1 is a perspective view of a device according to the invention in place on a conventional beverage container and straw.
Figure 2:
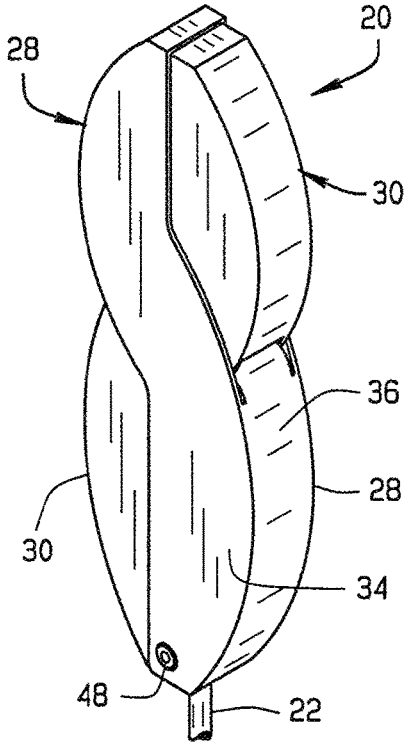
FIG. 2 is an enlarged perspective view of the device according to the invention, as shown in FIG. 1.

Referring to FIGS. 1 through 4, a device 20 of the invention is shown installed on a straw 22. Straw 22 is shown inserted into a beverage container 24 held by a consumer 26. Device 20 includes two interdigitated shells or elements 28 and 30 which may be substantially hollow and each comprising substantially half of device 20.

Figure 3:
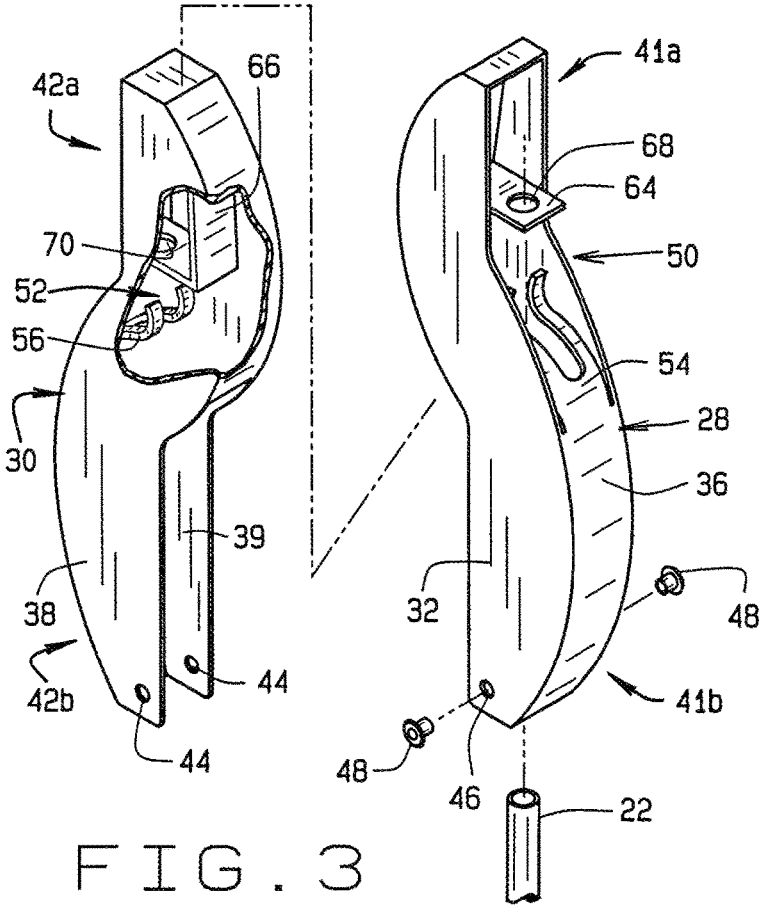
FIG. 3 is an exploded view of the device according to the invention, as shown in FIG. 2.
Figure 4:
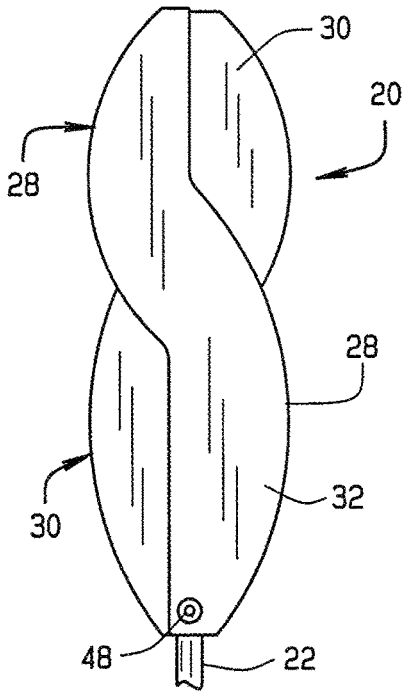
FIG. 4 is a front view of the device according to the invention.
Figure 5:
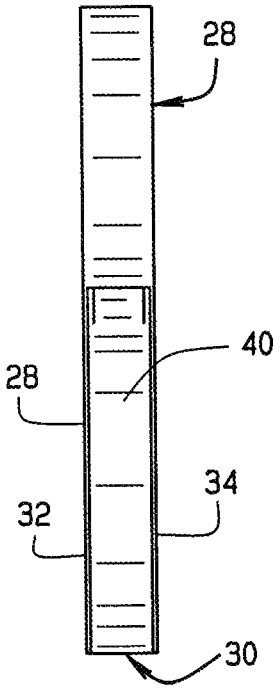
FIG. 5 is a left side view of the device according to the invention.
Figure 6:
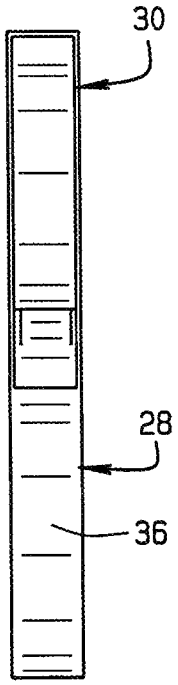
FIG. 6 is a right side view of the device according to the invention.
Figure 7:
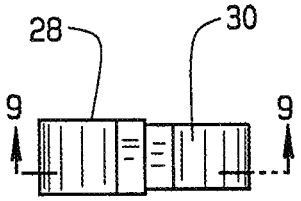
FIG. 7 is a top plan view of the device according to the invention, as shown in FIGS. 2 and 4, in a closed position.
Figure 8:
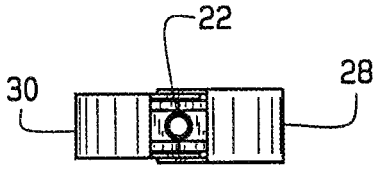
FIG. 8 is a top plan view of the device according to the invention in the open position and rotated one hundred eighty degrees in the plane of the drawing.

As shown, element 28 of device 20 is open with side walls 32 and 34 which are joined by a back wall 36. Element 30 has side walls 38 and 39 which are joined by a back wall 40. Upper portions 41*a* and 42*a* of elements 28 and 30 are substantially open, as shown in FIG. 3, as are lower portions 41*b* and 42*b*.

Element 28 may be sized slightly larger than element 30 so that element 30 may be passed through open portion 41*a* of element 28 and interdigitated within lower portion 41*b* of element 28 between sidewalls 32 and 34. Elements 28 and 30 may be provided with apertures 44 and 46 which permit elements 28 and 30 to be pivotally attached by a conventional fastener 48, such as a rivet, screw and the like.

Upper portions 50 and 52 of walls 36 and 40 may be relieved to form two spring like members 54 and 56. Spring like members 54 and 56 are substantially free of walls 36 and 40 and may move substantially independently of walls 36 and 40, as described herein. As shown in FIG. 3, spring like members 54 and 56 may be bifurcated.

Figure 9:
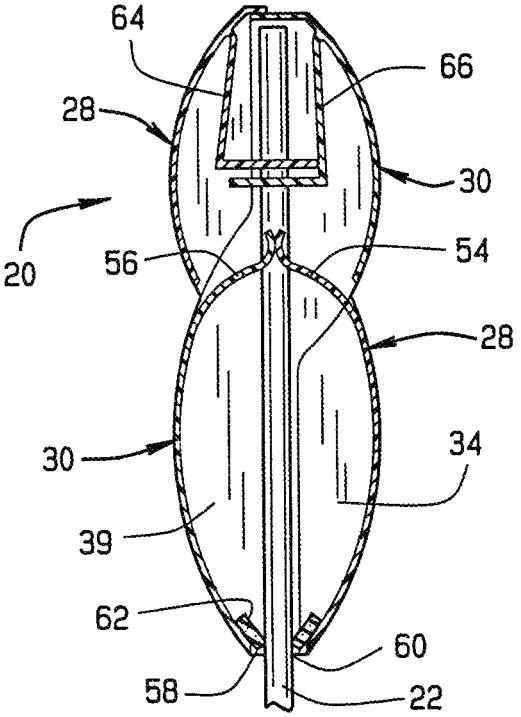
FIG. 9 is a front cross-sectional view taken along the plane 9-9 in FIG. 4.
Figure 10:
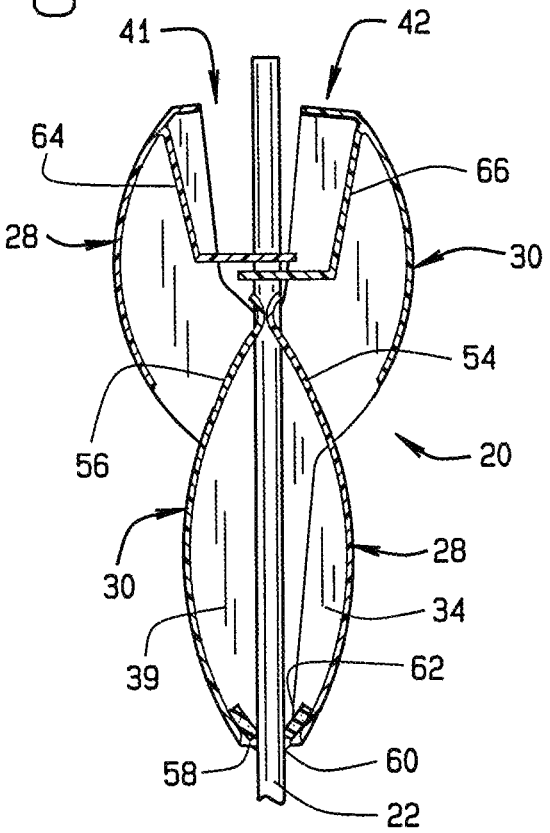
FIG. 10 is a front cross-sectional view similar to FIG. 9, but with the device in the open position.

Referring to FIGS. 9 and 10, elements 28 and 30 of device 20 may have an open bottom 58 forming an aperture 60 through which straw 22 may be received. Aperture 60 may be sized to avoid restricting the vertical movement of straw 22. The gap between aperture 60 and straw 22 may be closed by a soft washer 62, such as a foam washer, which will provide a minimal contact with straw 22 and will not substantially restrict the vertical movement of straw 22.

Upper portions 41*a* and 42*a* of elements 28 and 30 contain lifting levers 64 and 66. Lifting levers 64 and 66 also contain apertures 68 and 70. Apertures 68 and 70 may cooperate to receive straw 22 therein. Apertures 68 and 70 may be sized to provide a snug fit between lifting levers 64 and 66 and straw 22, but that is not critical, as described further herein. Lifting levers 64 and 66 are shown as being formed substantially at a right angle. However, it will be appreciated that lifting levers 64 and 66 may be formed as curved levers, as straight levers or may be formed as having angles other than right angles.

Device 20 of the invention may be formed of conventional materials and is preferably formed of resilient materials such as resilient plastics and polymers. Materials such as polyvinyl chloride, polyethylene, polypropylene and the like are suitable materials of construction for device 20 of the invention. These materials, and others, may be formed into device 20 by suitable conventional methods. Typically plastic fabrication techniques may be used. The plastic fabrication techniques may include injection molding, vacuum molding and the like. Various parts of device 20 may be formed by one technique and then joined, for example by welding, into device 20.

Device 20 is used by threading a top portion of straw 22 through aperture 60 in the bottom 58 of elements 28 and 30. Straw 22 is threaded further through bifurcated springs 54 and 56 and through apertures 68 and 70 in lifting levers 64 and 66, as shown in FIG. 9. In the position shown in FIG. 9 straw 22 is enclosed within device 20 and protected from dirt, insects and other contaminants.

The lower portion of straw 22 is connected in a cooperating relationship with beverage container 24 as shown in FIG. 1. The top portion of straw 22 may be accessed, and the beverage in container 24 consumed, by opening device 20 to the position shown in FIG. 10. The position shown in FIG. 10 is achieved by compressing lower portions 41*b* and 42*b* of device 20, for example, by applying pressure to walls 36 and 40. As pressure is applied to walls 36 and 40 elements 28 and 30 pivot through each other and open device 20 to the position shown in FIG. 10.

As elements 28 and 30 pivot, bifurcated springs 54 and 56 elongate and move upward and apertures 68 and 70 in lifting levers 64 and 66 rotate upwardly. The periphery of apertures 68 and 70 impinge on straw 22 with a biased or cross gripping action and lift straw 22 above device 20, as shown in FIG. 10. In the position shown in FIG. 10 straw 22 may be used in a conventional manner to consume a beverage from beverage container 24.

Figure 11:
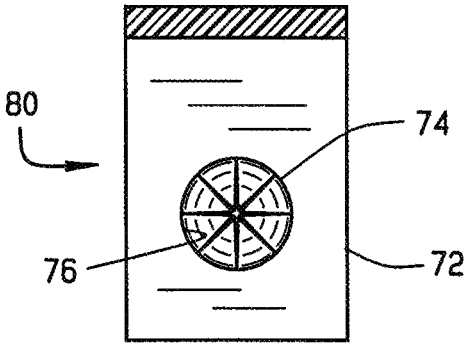
FIG. 11 is a detail view, in schematic, of an alternative embodiment of the device of the invention.

As shown, for example in FIG. 3, apertures 68 and 70 in lifting levers 64 and 66 may be open and circular in configuration. It will be appreciated that other constructions may also be used. FIG. 11 shows a partial top view of a modified lifting lever 72 having an aperture 74. Aperture 74 is closed by a scored circular boundary 76 surrounding a series of radial cuts 78. Radial cuts 78 produce a diaphragm 80 through which straw 22 may be inserted. Diaphragm 80 grips straw 22 which will be lifted by lifting lever 72, as previously described for lifting levers 64 and 66.

Figure 12:
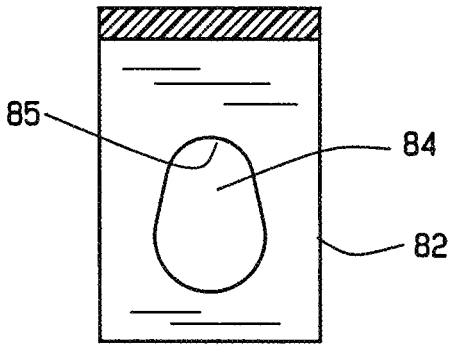
FIG. 12 is a detail view, in schematic, of a further alternative embodiment of the device of the invention; and, FIG. 13 is a detail view, in schematic, of a further alternative embodiment of the device of the invention.

FIG. 12 shows a further modification of a lifting lever 82. In this instance, lifting lever 82 has an open elliptical aperture 84 therethrough. Elliptical aperture 84 loosely surrounds straw 22 in the position shown in FIG. 9. However, as lifting levers 82 rotate to the position shown in FIG. 10 straw 22 is pulled into a narrow end 85 of aperture 84 and into a snug contact with lifting lever 82 which lifts straw 22 to the position shown in FIG. 10.

As shown in FIG. 3, springs 54 and 56 are bifurcated and may not be in contact with straw 22. The upper ends of the springs 54 and 56 may contact each other, as shown in FIGS. 9 and 10, and maintain the shape of device 20. When pressure is removed from the walls 36 and 40 bifurcated springs 54 and 56 return device 20 to the position shown in FIGS. 2, 4 and 9, for example.

Figure 13:
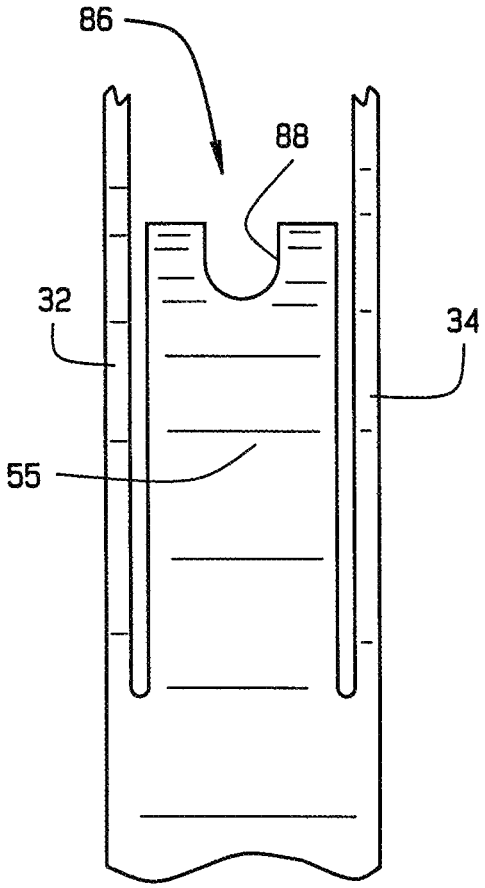

FIG. 13 shows a modified spring 55 which may also be used in device 20 of the invention. The modified spring 55 has a much smaller bifurcated portion 86. A relieved portion 88 of modified spring 55 may be a portion of a circle or an ellipse, or other shape, and may be in contact with straw 22. When walls 36 and 40 of device 20 are compressed modified spring 55 is elongated vertically, as are bifurcated springs 54 and 56. However, due to the contact between modified spring 55 and straw 22, modified spring 55 may provide additional lifting force to straw 22.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A device for use to consume beverages comprising an enclosing shell for a straw, the enclosing shell having a plurality of elements at least partially interdigitated and wherein each of said elements has a spring therein, the interdigitated elements being joined at a pivot point, the interdigitated elements being at least partially pivotable around the pivot point to selectively open and close the shell, the shell having an aperture therein for receiving a straw therethrough, the shell having at least one lifting member therein, the lifting member cooperating with at least one of the shell elements to selectively extend and retract a straw received therein.

2. The device of claim 1 wherein the device has at least two lifting members and wherein the lifting members cooperate to produce a cross gripping action on a straw received therein.

3. The device of claim 1 wherein the straw receiving aperture has a seal thereon.

4. The device of claim 3 wherein the seal is a soft washer seal.

5. The device of claim 1 wherein the shell elements have springs therein and the springs are positioned in an opposing relationship.

6. The device of claim 1 wherein the shell elements have wall portions thereon and wherein the wall portions are at least partially relieved to form each spring.

7. The device of claim 6 wherein the spring is bifurcated.

8. The device of claim 7 wherein the spring cooperates to close the shell.

9. The device of claim 7 wherein the spring receives a straw therebetween.

10. The device of claim 1 wherein the springs biasing the shell elements in a closed relationship, the device being operable to compress the springs and pivot the shell elements around the pivot point to place the device in an open position, the springs cooperating to return the device to a closed position on removal of the compression from the springs, the device having a plurality of opposed lifting members therein, the lifting members having apertures therein for receiving a straw, the lifting members cooperating to lift a straw received therein on opening of the device, the lifting members further cooperating to retract a straw received therein on closing of the device.

11. A device for use to consume beverages comprising an enclosing shell for a straw, the enclosing shell having at least two shell elements, at least one of the shell elements having an opening therein for receiving a straw therethrough, the two shell elements being at least partially interdigitated, the two shell elements being pivotally joined at an extremity thereof, the two shell elements each having walls at least partially enclosing the protective enclosure, the walls being in a spaced relationship, the walls being at least partially relieved to provide opposed spring members thereon, the two shell elements each having levers thereon, the levers each having apertures therein, the apertures being sized to receive a straw therethrough and cooperating to impinge against a straw received therein with a biasing grip, the levers cooperating to extend a straw received therethrough on opening of the protective enclosure and to retract a straw received therethrough on closing of the protective enclosure.

12. The device of claim 11 wherein the straw receiving opening has a seal thereon.

13. The device of claim 12 wherein the seal is a soft washer seal.

14. The device of claim 11 wherein the levers cooperate to produce a cross gripping action on a straw received therethrough.

15. The device of claim 11 wherein the spring members are bifurcated.

16. The device of claim 15 wherein the spring members may receive a straw therebetween.

17. The device of claim 11 wherein the device is operable to compress the springs and at least partially pivot the shell elements to place the device in an open position, the springs cooperating to return the device to a closed position on removal of the compression from the springs.

18. The device of claim 11 wherein the springs bias the shell elements in a closed relationship.

* * * * *